US008342923B2

(12) United States Patent
Mavroudis et al.

(10) Patent No.: US 8,342,923 B2
(45) Date of Patent: Jan. 1, 2013

(54) COVER FOR ENVIRONMENTAL CONTROL SYSTEM VENT

(75) Inventors: Tom Mavroudis, Massapequa, NY (US); Bill Caporale, Massapequa Park, NY (US)

(73) Assignees: Thomas Mavroudis, Massapequa, NY (US); William Caporale, Massapequa, NY (US)

( * ) Notice: Subject to any disclaimer, the term of this patent is extended or adjusted under 35 U.S.C. 154(b) by 765 days.

(21) Appl. No.: 12/381,878

(22) Filed: Mar. 16, 2009

(65) Prior Publication Data

US 2010/0233952 A1 Sep. 16, 2010

(51) Int. Cl.
*F24F 7/00* (2006.01)

(52) U.S. Cl. ..... 454/275; 454/307

(58) Field of Classification Search ..... 454/275, 454/292, 307

See application file for complete search history.

(56) References Cited

U.S. PATENT DOCUMENTS

| | | | | |
|---|---|---|---|---|
| 510,884 | A | 12/1893 | Bradley | |
| 716,450 | A | 12/1902 | Maloney | |
| 1,624,226 | A * | 4/1927 | Elters | 454/289 |
| 2,230,203 | A | 1/1941 | Ludwig et al. | |
| 2,369,119 | A | 2/1945 | Dauphinee | |
| 2,558,421 | A | 6/1951 | Daninhirsch | |
| 2,858,760 | A | 11/1958 | Lathrop | |
| 2,959,832 | A | 11/1960 | Baermann | |
| 3,358,578 | A * | 12/1967 | Meyer | 454/307 |
| 3,768,235 | A * | 10/1973 | Meyer et al. | 55/385.5 |
| 3,845,983 | A | 11/1974 | Heintz | |
| 3,894,527 | A | 7/1975 | Ickes | |
| 4,106,399 | A | 8/1978 | Lawrence | |
| 4,130,966 | A | 12/1978 | Kujawa et al. | |
| 4,182,227 | A | 1/1980 | Roy | |
| 4,201,122 | A | 5/1980 | Maciag | |
| 4,325,229 | A | 4/1982 | DeZurik | |
| 4,469,018 | A | 9/1984 | Taulman | |
| 4,625,784 | A | 12/1986 | Boroson | |
| 4,693,174 | A | 9/1987 | Anderson | |
| 4,759,194 | A | 7/1988 | Shapiro | |
| 4,788,805 | A | 12/1988 | Shaw | |
| 5,054,377 | A | 10/1991 | Mochel et al. | |
| 5,081,914 | A | 1/1992 | Mejia | |
| 5,125,197 | A | 6/1992 | Fuchs | |
| 5,232,403 | A * | 8/1993 | Marotta | 454/289 |
| D355,354 | S | 2/1995 | Sterling | |

(Continued)

FOREIGN PATENT DOCUMENTS

| | | |
|---|---|---|
| EP | 1310743 | 5/2003 |

(Continued)

*Primary Examiner* — Steven B McAllister
*Assistant Examiner* — Samantha Miller
(74) *Attorney, Agent, or Firm* — Limin Wen

(57) ABSTRACT

An assembly for covering a grill of an air conditioning vent in the winter comprises a cover having a frame that may have a hole on a top surface and sides including a compressible material along its perimeter for sealing a vent area. In one preferred embodiment, the assembly includes an elastic cord having a looped end and a free end, the looped end being of adjustable size and having two hooks slidably connected to the cord. The hooks are configured to attach to the grill and pulling the free end of the cord tightens the looped end and the hooks. The free end may be attached to the cover so that sliding a barrel lock up the cord urges the cover against the vent area and prevents unwanted upward hot air flow and downward cold air flow in the winter when the air conditioning system is not in use.

4 Claims, 16 Drawing Sheets

U.S. PATENT DOCUMENTS

| | | | | | |
|---|---|---|---|---|---|
| 5,479,984 | A | | 1/1996 | Easterbrook | |
| 5,498,203 | A | * | 3/1996 | Reichert | 454/289 |
| 5,525,145 | A | | 6/1996 | Hodge | |
| 5,556,335 | A | * | 9/1996 | Holyoake | 454/258 |
| 5,561,952 | A | | 10/1996 | Damron | |
| 5,658,196 | A | * | 8/1997 | Swaim | 454/300 |
| 5,724,701 | A | | 3/1998 | Jones | |
| D394,901 | S | | 6/1998 | Governale et al. | |
| 5,876,282 | A | | 3/1999 | Kenny | |
| 5,937,073 | A | * | 8/1999 | Van Gieson | 381/391 |
| 5,966,773 | A | | 10/1999 | Jones | |
| 6,035,484 | A | | 3/2000 | Jones | |
| 6,061,981 | A | | 5/2000 | Nieves | |
| 6,149,514 | A | | 11/2000 | Maury | |
| 6,261,174 | B1 | | 7/2001 | Kuehn | |
| 6,916,240 | B1 | | 7/2005 | Morton | |
| 6,978,803 | B2 | | 12/2005 | Brown et al. | |
| 7,422,273 | B2 | | 9/2008 | Varga | |
| 7,635,298 | B2 | * | 12/2009 | Henneberry | 454/307 |
| 2003/0134587 | A1 | | 7/2003 | Hunter | |
| 2008/0160904 | A1 | * | 7/2008 | Yi et al. | 454/309 |

FOREIGN PATENT DOCUMENTS

| | | |
|---|---|---|
| EP | 1316760 | 6/2003 |
| EP | 1326054 | 7/2003 |

* cited by examiner

COVER FOR ENVIRONMENTAL CONTROL SYSTEM VENT

BACKGROUND OF THE INVENTION

The present invention generally relates to apparatus and methods for covering vents in environmental control systems and, more particularly, to apparatus and methods of sealing off a vent used for a central air conditioning system from an indoor environment while the indoor environment is being heated with a separate central or other heating system.

For homes or other environments in which a central air condition system is used to control the environment during the summer and a separate heating system is used to heat the environment during the winter, a problem arises during the season in which the air conditioning vent is not in use and the heating system is being used. During that time, the ceiling vents for the central air conditioning system are not air tight since the attic of a home is never sealed off from outside air. As a result, ducts and air-conditioning system components such as ductwork, duct distribution manifold, and air handler/blower units that may be located in the attic are exposed to cold air from outside. Consequently, when hot air produced by the separate heating system rises, travels though the central air conditioner vents and then travels into and through the cold ductwork and air handler of the air conditioning system in the attic, this hot air is cooled into cold air. This cold air then drops and is re-distributed through the vents in the house, which is manifested by a cool breeze emanating from these vents. This causes a loss of energy in that more heating is necessary to heat the environment.

In addition, the relatively hot air that rises into the cold air ducts also tends to be moist. The moisture in the warm air will condense on the cold ducts. Condensation in the air ducts can cause mold to form. Moisture will also condense and then freeze on the air handling unit causing microscopic cracks in refrigerant coil. This in turn yields leakage of refrigerant and necessitates a service call to be generated to fix the problem when it is discovered.

Prior art covers for the air vents are magnetic, in which case they are useless for the majority of grills which tend to be made of plastic. Other prior art covers for the air vents are shaped for only particular sizes of vents. As can be seen, there is a need for a method and apparatus for sealing any kind or shape of air conditioning vent.

SUMMARY OF THE PRESENT INVENTION

In one aspect of the present invention, there is presented an assembly for covering a grill of an air conditioning vent, comprising a cover; and a cord having a looped end and a free end, the looped end being of adjustable size and having two hooks slidably connected to the cord, the hooks configured to attach to the grill, the cord being elastic so that pulling the free end of the cord tightens the looped end and the hooks, the free end attached to the cover so that sliding a bottom element up the cord from below the cover urges the cover against a vent area.

In a further aspect of -the invention, there is presented a method of sealing an air conditioning vent, comprising attaching a first hook adjoining a looped end of an elastic cord onto a first side of a grill of the vent; attaching a second hook adjoining the looped end of the elastic cord onto a second side of the grill, the second side opposite the first side; inserting a free end of the elastic cord through an aperture in a vent cover; covering the air conditioning vent with the vent cover; and sealing the vent cover.

In a still further aspect of the present invention, there is presented an assembly for covering a grill of a central air conditioning vent, comprising an elastic cord having a looped end and a free end, the looped end being of adjustable size and having two attachment elements slidably connected to the cord, the attachment elements configured to attach to the grill; and a cover having a rigid or semi-rigid frame, the frame having a top and sides, the top having at least one aperture for insertion of the cord, the sides having a perimeter to which a flexible sealing material is attached, the sides of the frame rising along a generally perpendicular step and then further rising to a top of the frame along a line inclined at an approximately 45 degree angle with the top; the free end of the elastic cord extending through the aperture and fitted with a lock.

In a still further aspect of the present invention, there is presented an assembly for covering a central air conditioning vent, the vent having a grill, the assembly comprising an elastic cord having a hook at a free end, the hook configured to attach to the grill; and a cover having a rigid or semi-rigid frame, the frame having a top and sides, the top having at least one aperture for insertion of the cord, the sides having a perimeter to which a flexible sealing material is attached, the sides of the frame rising from the perimeter along a generally perpendicular step and then further rising to the top along a line inclined at an approximately 45 degree angle with the top; the free end of the elastic cord extending through the aperture and fitted with a lock.

These and other features, aspects and advantages of the present invention will become better understood with reference to the following drawings, descriptions and claims.

DETAILED DESCRIPTION OF THE INVENTION

Figure 1A:
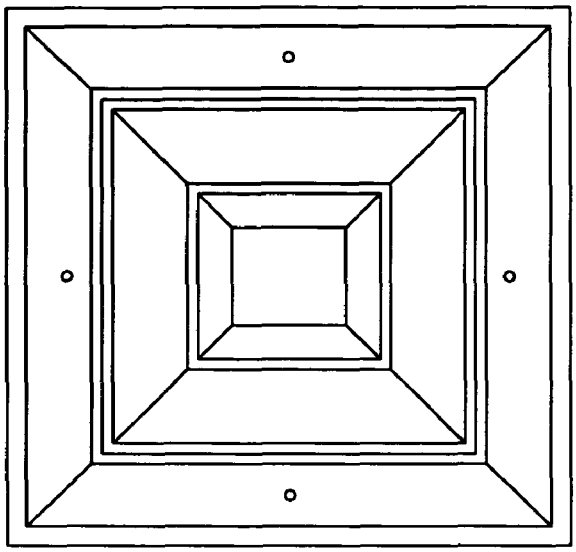
(PRIOR ART) FIG. 1A
FIG. 1A through FIG. 1I are prior art air conditioning grills of various shapes and configurations.
Figure 1B:
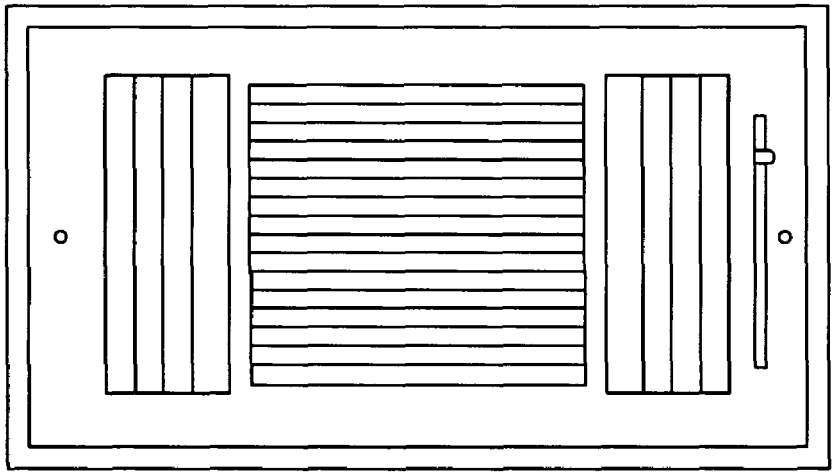
(PRIOR ART) FIG. 1B
Figure 1C:
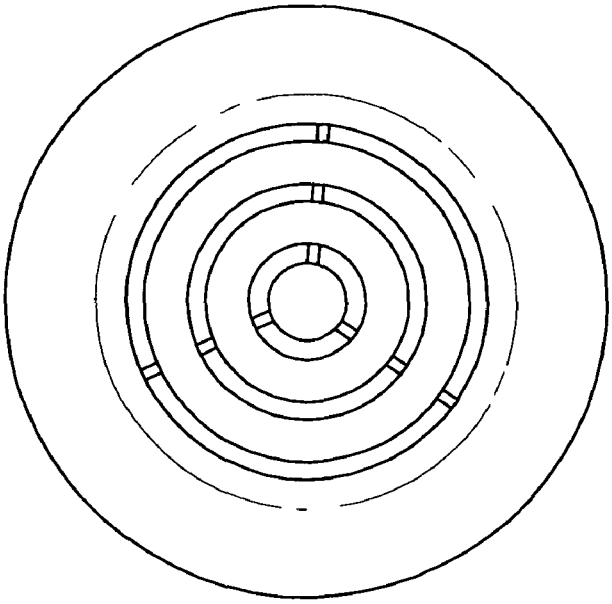
(PRIOR ART) FIG. 1C
Figure 1D:
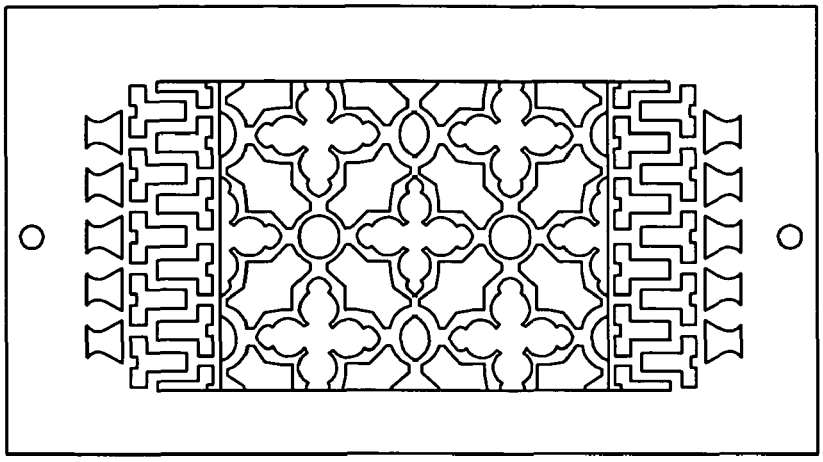
(PRIOR ART) FIG. 1D
Figure 1E:
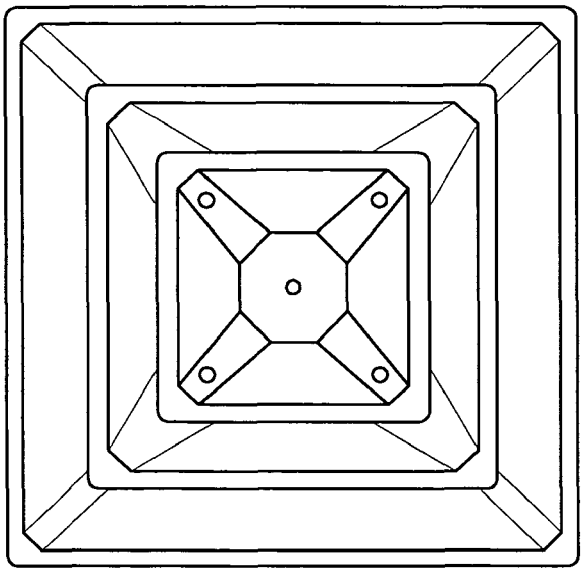
(PRIOR ART) FIG. 1E
Figure 1F:
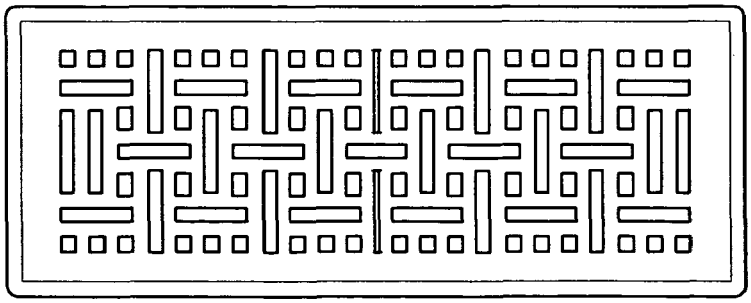
(PRIOR ART) FIG. 1F
Figure 1G:
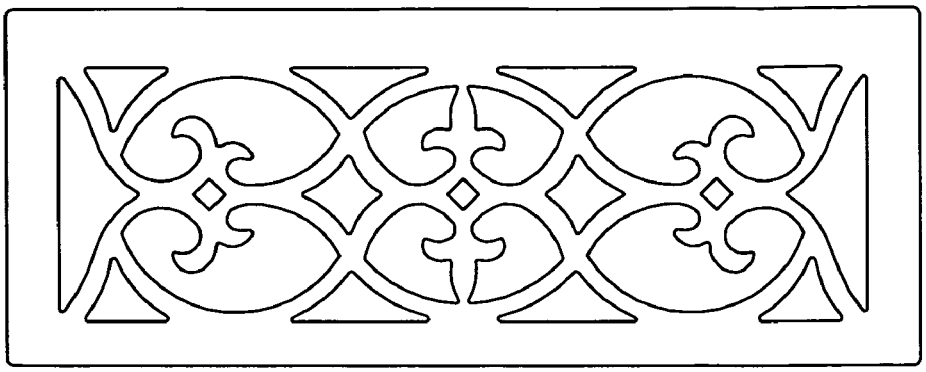
(PRIOR ART) FIG. 1G
Figure 1H:
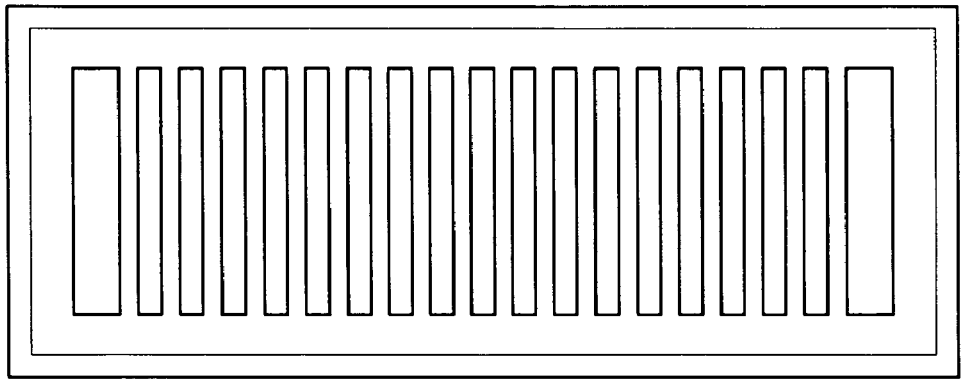
(PRIOR ART) FIG. 1H
Figure 1I:
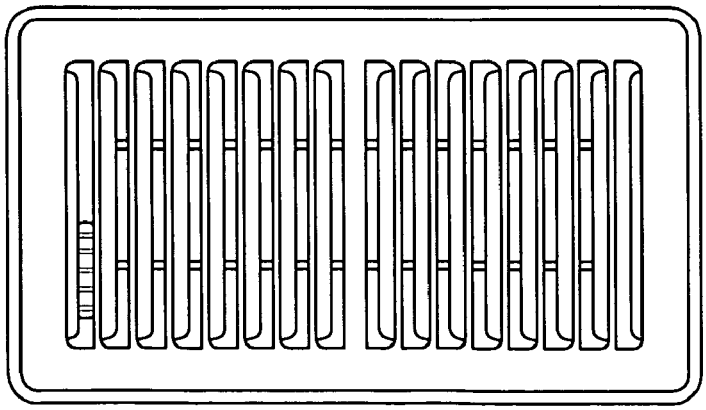
(PRIOR ART) FIG. 1I

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally provides an assembly for covering the grill of a central air conditioning vent or of a wall air conditioning vent in homes (or offices) having a dual HVAC system during the winter when the air conditioning system is not in use and a separate heating system is being used. The assembly may prevent the relatively hot air in the home (or office) from escaping through the vent to the ducts (in the case of a central air conditioning system) and to prevent cold air from entering the home (or office) through the vent. The assembly may be applicable to environments where heat is not coming through air conditioning ducts. The assembly may include an elastic cord having a looped end with slidably attached hooks that attach to the grill and may include a rigid or semi-rigid cover, for example plastic. The cover may be generally rectangular and may have a compressible material, such as foam, around its perimeter. Following the method of the present invention, the looped end of the elastic cord may be attached to the grill and then tightened by pulling the free end. The free end attached to the cover, for example by inserting through a hole in a top part of the cover frame, so that sliding a bottom element such as a barrel lock up the cord from below the cover urges the cover against the vent area around the grill to create an air-tight seal using the compressible material.

In contrast to the prior art, in which covers for air conditioning vents are magnetic and cannot be used for non-metallic grills, the method and assembly of the present invention may not employ magnets and may fit any grill regardless of the material made from. In further contrast to the prior art, in which the cover is designed to fit over grills of a particular size or shape, the method and assembly of the present invention works with any size or shaped grill. In contrast to the prior art in which adhesive or Velcro® is used to attach to the vent area and removing the device when the air conditioning system is needed causes paint around the vent area to be stripped and looks ugly, the method and assembly of the present invention may allow removal of the assembly without leaving any marks or stripping any paint. In further contrast to the prior art, which may require tools or complicated installation and/or removal, the method and assembly of the present invention may seal the air conditioning vent from air flow without any tools and may be installed and removed without constructing anything in a matter of seconds. For example, the installation of the double hook embodiment may occur in approximately 15 seconds, not including sticking the free end into storage for aesthetic reasons. In contrast to prior art devices which do not adequately insulate against air flow, the method and assembly of the present invention may be installed and effectively insulate against air flow and prevent heat loss and associated extra energy costs.

Figure 2:
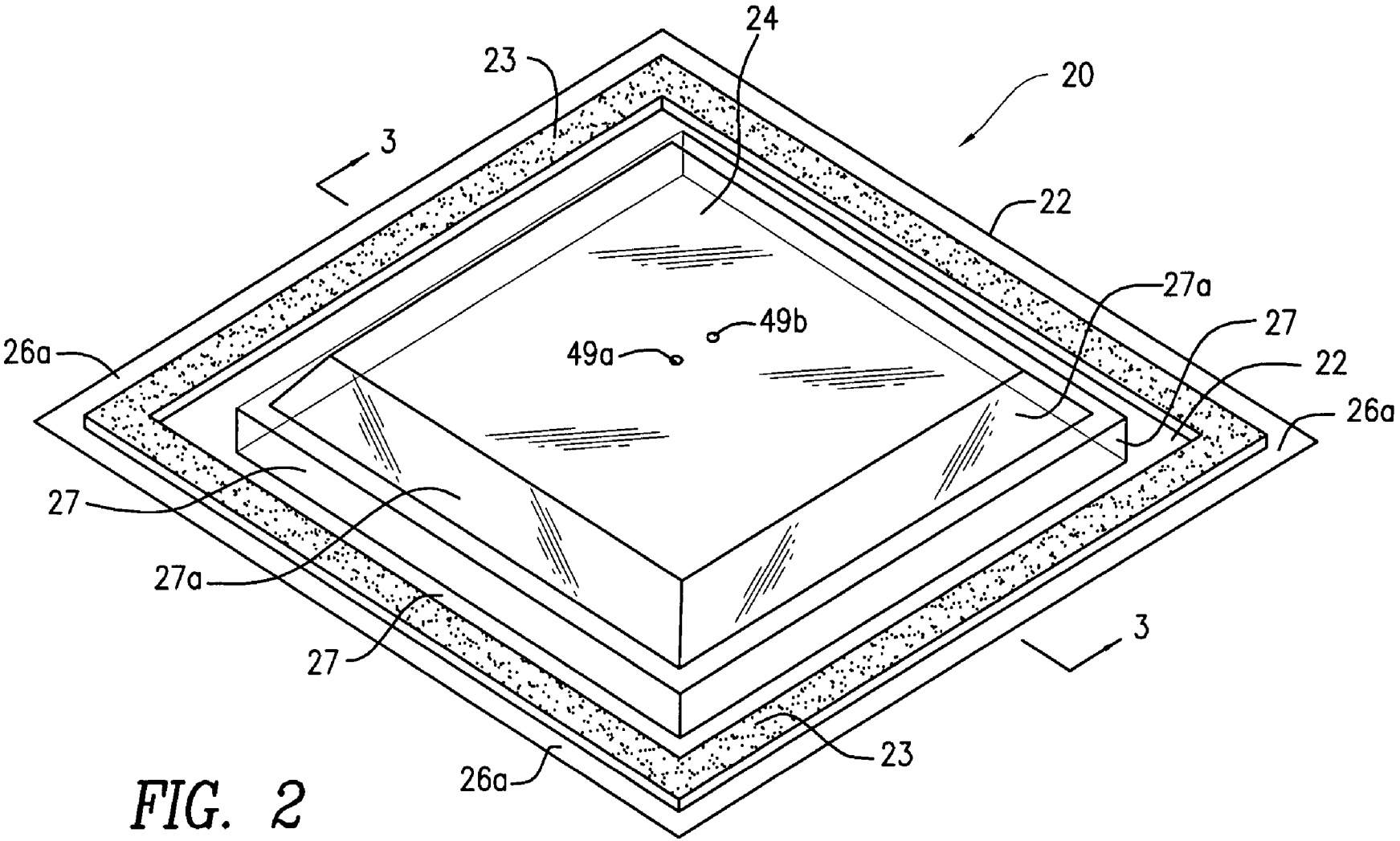
FIG. 2 is a perspective view of a cover of an assembly of the present invention.
Figure 6A:
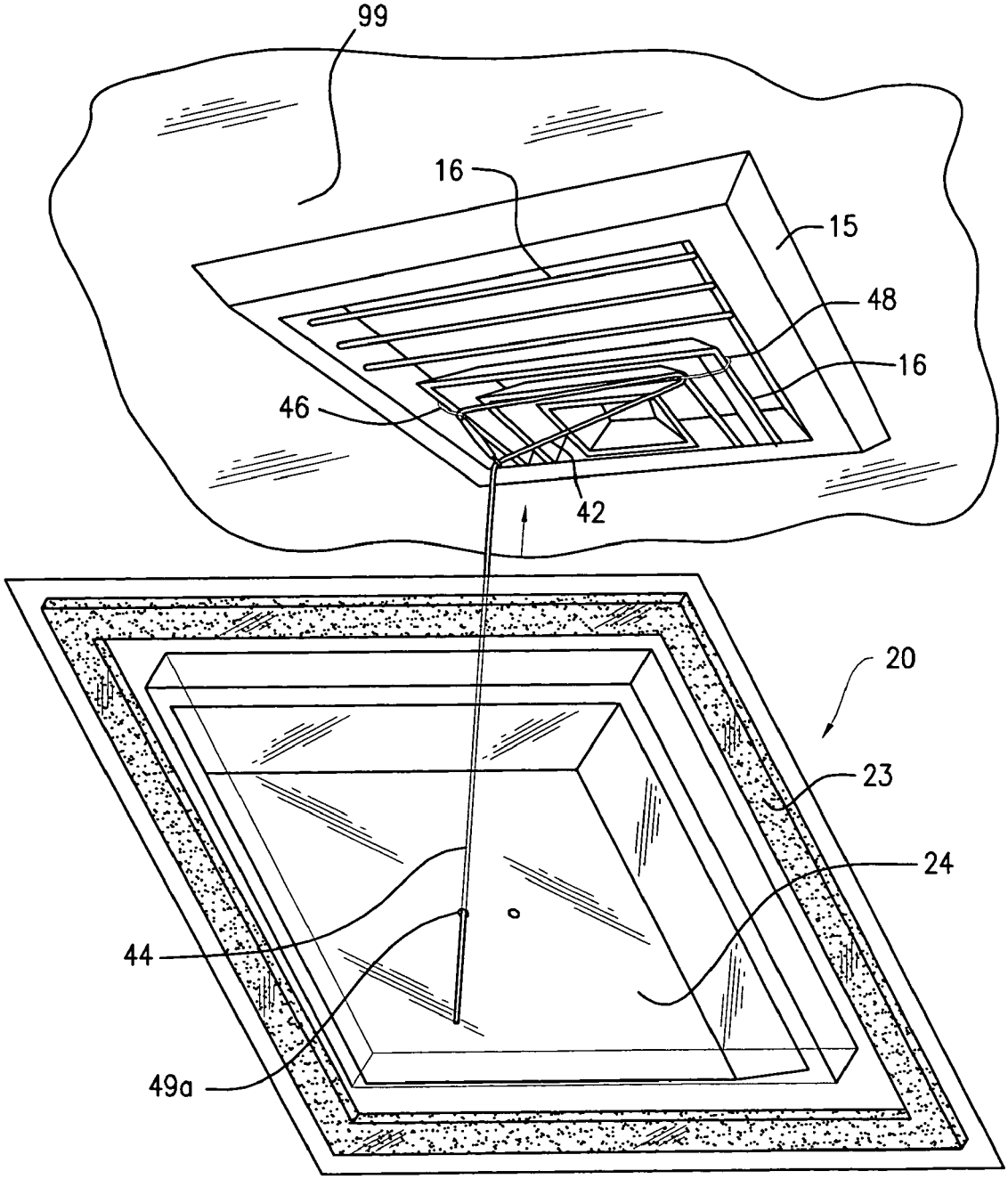
FIG. 6A is a perspective view of the assembly in accordance with one embodiment of the present invention being installed on a ceiling air conditioning vent in accordance with one preferred embodiment of the method of the present invention.
Figure 6B:
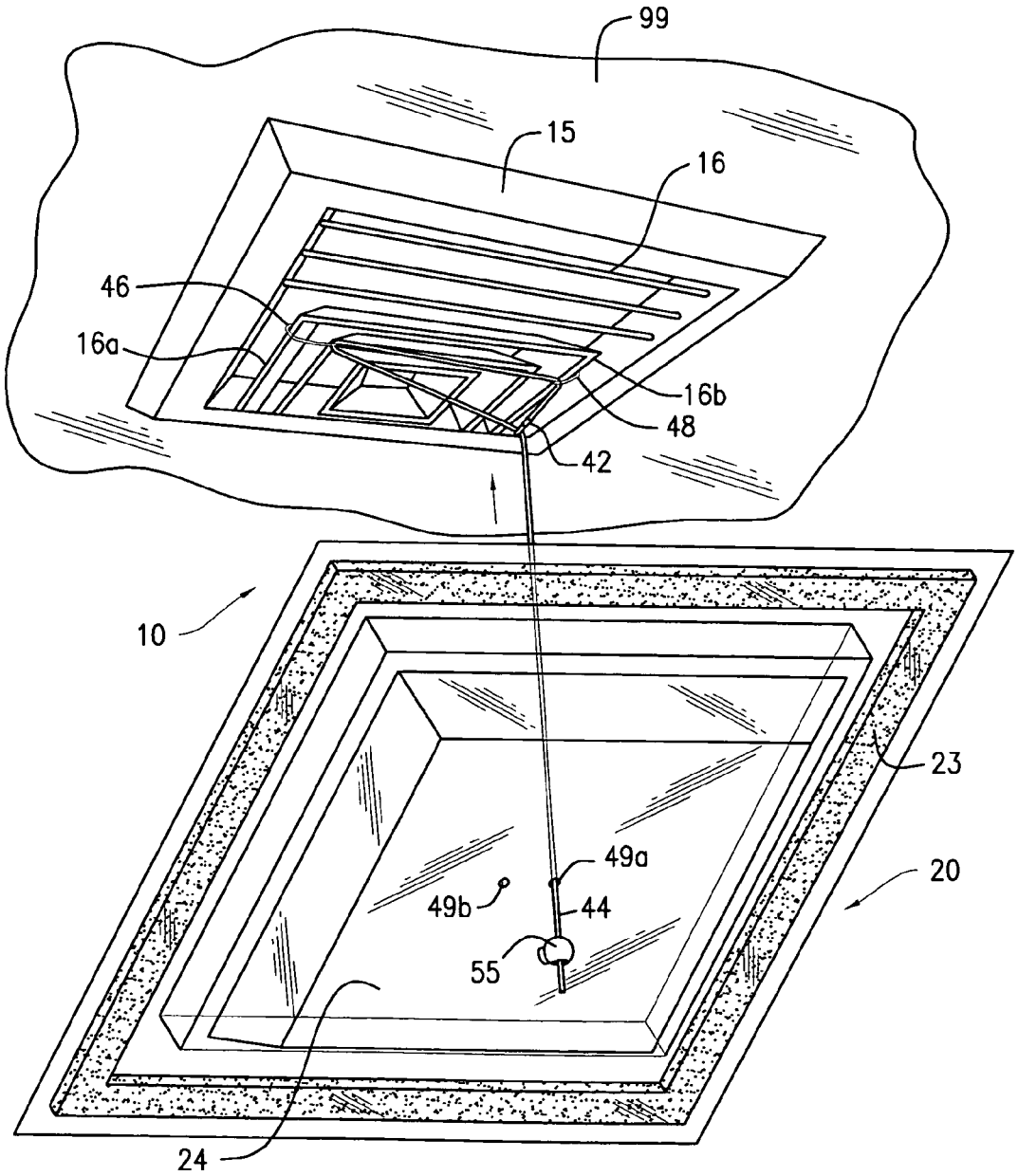
FIG. 6B is a perspective view of the assembly in accordance with one embodiment of the present invention being installed on a ceiling air conditioning vent in accordance with one preferred embodiment of the method of the present invention.

As can be seen from FIG. 2 and from FIG. 6B, an assembly 10 for covering a grill 16 of an air conditioning vent 15 includes a cover 20 having a rigid or semi-rigid frame 22, the frame 22 having a top 24 and sides 26. Top 24 may have two holes for insertion of a cord 30. Sides 26 of frame 22 may have a perimeter 26*a* to which a foam 23 or other compressible material 23 may be attached for contacting the vent area 99 and thereby may override any irregularities in the surface of the vent area 99 and thereby may seal vent cover 20 against vent area 99 when the vent cover 20 may be pressed against vent 15. Compressible material 23 may lie inside a channel carved into perimeter/flange 26*a* although a portion of compressible material 23 may protrude outside the channel, to allow compression of this material 23.

Figure 3:
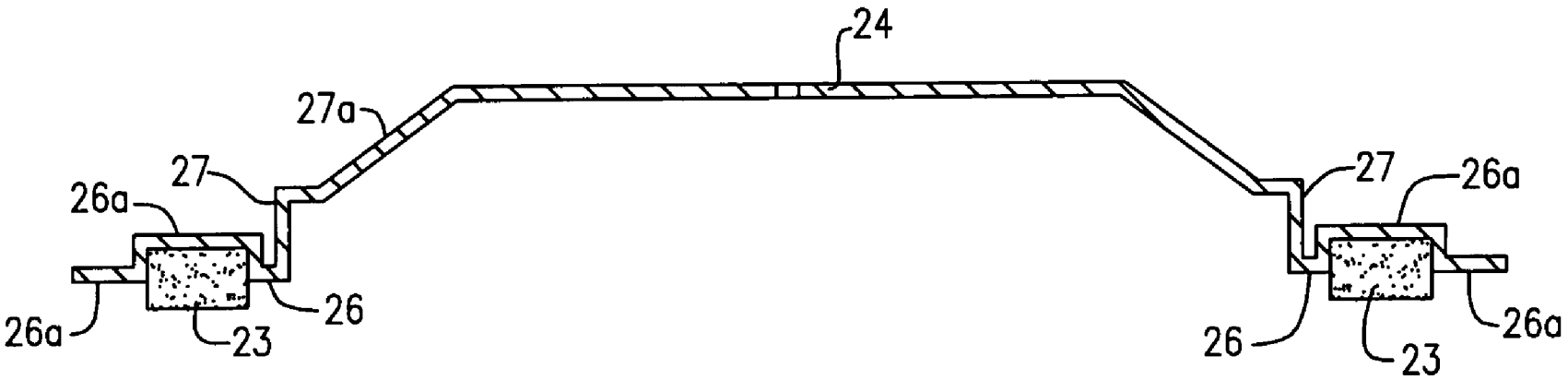
FIG. 3 is a sectional view of FIG. 2 taken along line 3-3.

As seen from FIG. 3, sides 26 of frame 22 may rise along a generally perpendicular step 27 and may then further rise to top 24 of frame 22 along a line 27*a* that may be inclined at an approximately 45 degree angle with top 24. Both step 27 and the inclined line 27*a* add stability to frame 22 and may equalize the distribution of forces exerted from cord 40 and top 24 to flange/perimeter 26*a*. Step 27 and/or inclined line 27*a* may be viewed as part of top 24 or as part of sides 26 of frame 22. Frame 22 may be semi-rigid or rigid, although typically, frame 22 may be rigid with the exception of step 27.

Figure 4:
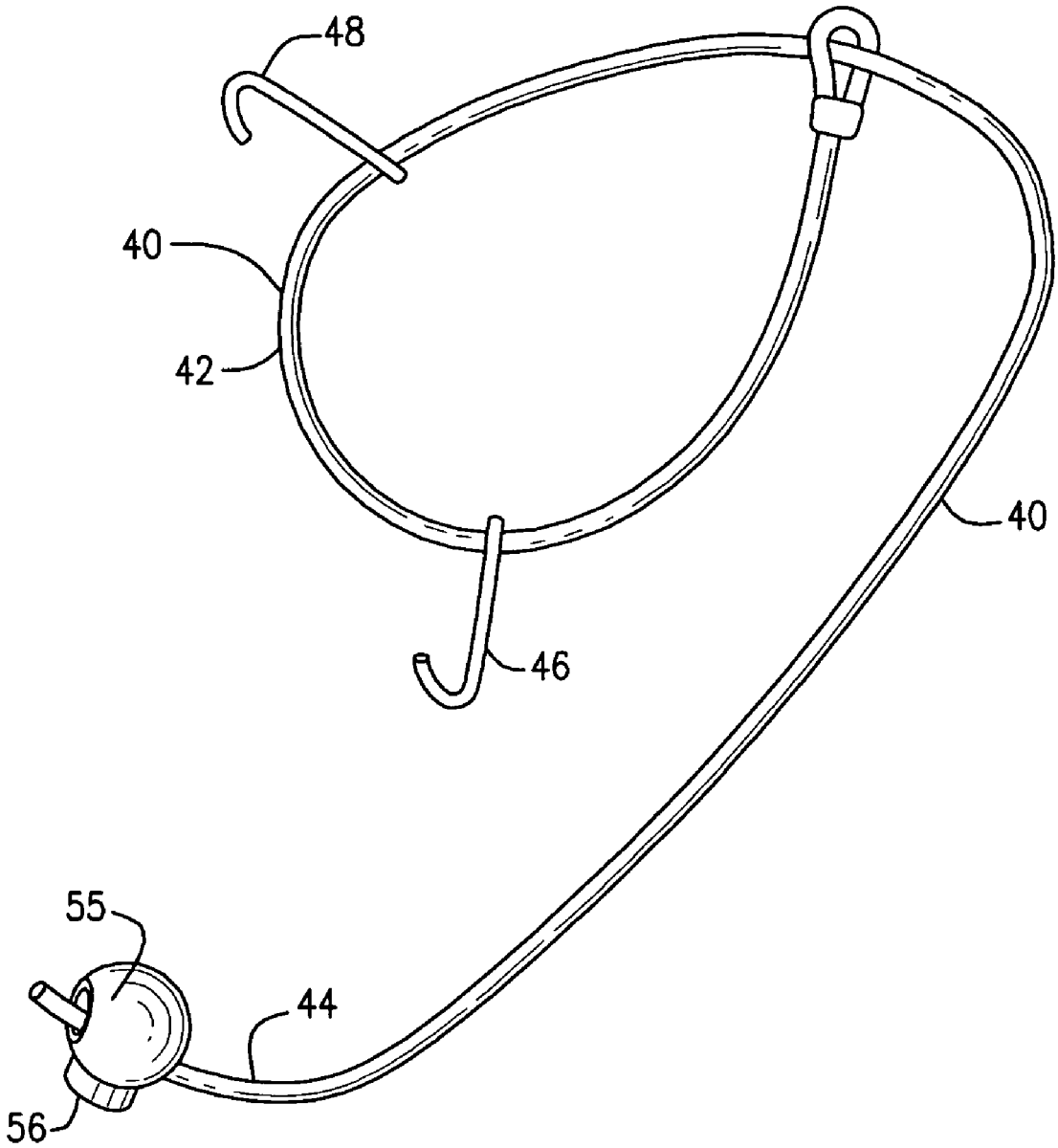
FIG. 4 is a perspective view of an elastic cord, in accordance with a preferred embodiment of the present invention, showing a looped end.

Assembly 10 may also include a cord 40, which may be elastic. As seen from FIG. 4, cord 40 may have a looped end 42 and a free end 44. Looped end 42 may be of adjustable size by adjusting the amount of cord 40 outside the loop. Looped end 42 may also have two hooks 46, 48 slidably connected to the cord. Hooks 46, 48 may be shaped or configured to attach to the grill 16. Significantly, they may be able to attach to any size and shaped grill 16 whether square or round or small or large, as seen from the variety of shapes and sizes and designs seen in prior art FIG. 1A through FIG. 11.

Figure 5:
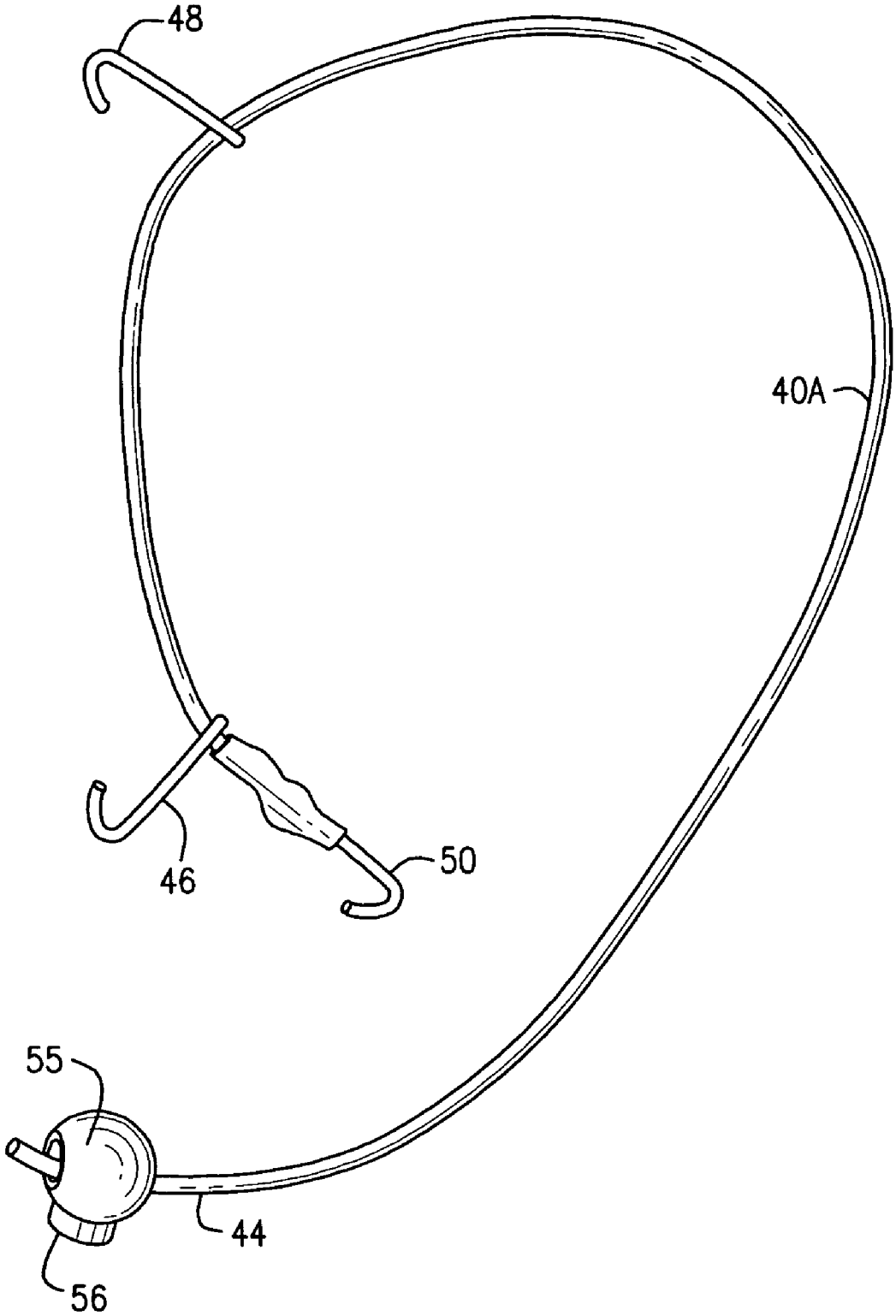
FIG. 5 is a perspective view of an elastic cord, in accordance with an alternative embodiment of the present invention, employing a hook at one end.

FIG. 5 shows an alternative embodiment of cord 40A in which third hook 50 replaces the looped end. Third hook 50 may be used to tighten the hooks 46A, 48A against grill 16. It has been found that while cord 40A may be generally effective, third hook 50, at least as configured in FIG. 5, may be liable to detach and render an assembly utilizing cord 40A comparatively inferior.

Cord 40 may be sufficiently elastic that pulling free end 44 of cord 40 may cause looped end 42 and hooks 46, 48 to tighten around grill 16. Looped end 42 of cord 40 may be sized and configured so that when tightened hooks 46, 48 hold opposite sides of grill 16 firmly as shown in FIGS. 6A, 6B, 7, 8 and 9. This pulling and tightening may occur after free end 44 has been inserted into cover 20. Cord 40 may be made of the kind of elastic material that is similar to a bungee cord.

Figure 7:
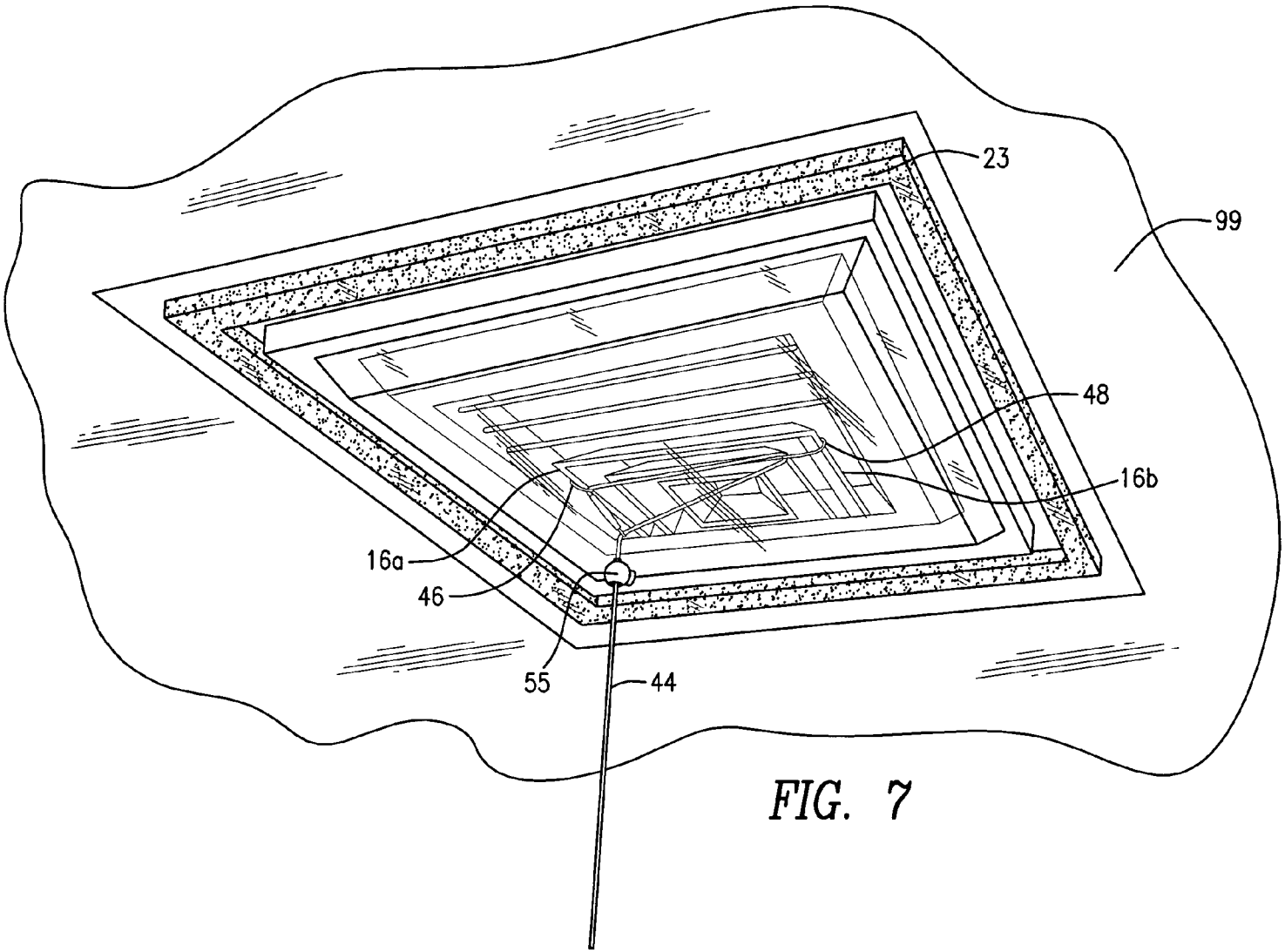
FIG. 7 is a perspective view of the assembly in accordance with one embodiment of the present invention being installed on a ceiling air conditioning vent in accordance with one preferred embodiment of the method of the present invention.

Free end 44 may be attached to cover 40 in a preferred way shown in FIG. 6 through FIG. 9. When looped end 42 is attached to grill 16 via hooks 46, 48, the remainder of cord 40 may be referred to as the trunk or slack of cord 40. As shown in FIG. 6A, free end 44 may first be slipped through first aperture 49*a* in cover 20 when cover 20 is upside down so that top 24 of cover 20 is facing down. Afterwards, as shown in FIG. 6B, a bottom element 55 such as lock 55, which may be a barrel lock 55 (see FIG. 4), may be fitted onto free end 44. Barrel lock 55 may contain a squeezable element 56 that holds lock 55 to cord 40 whenever squeezable element 56 is not being squeezed. As shown in FIG. 7, lock 55, which may be of larger diameter than aperture 49*a*, may then be slid up the trunk or slack of cord 40 hanging below cover 20 to move cover 20 upward and against vent area 99. At the same time, free end 44 may be pulled downward to tighten hooks 46, 48 around grill 16. After free end 42 has been pulled down and lock 55 has been moved to just below top 24 of cover 20

Figure 8:
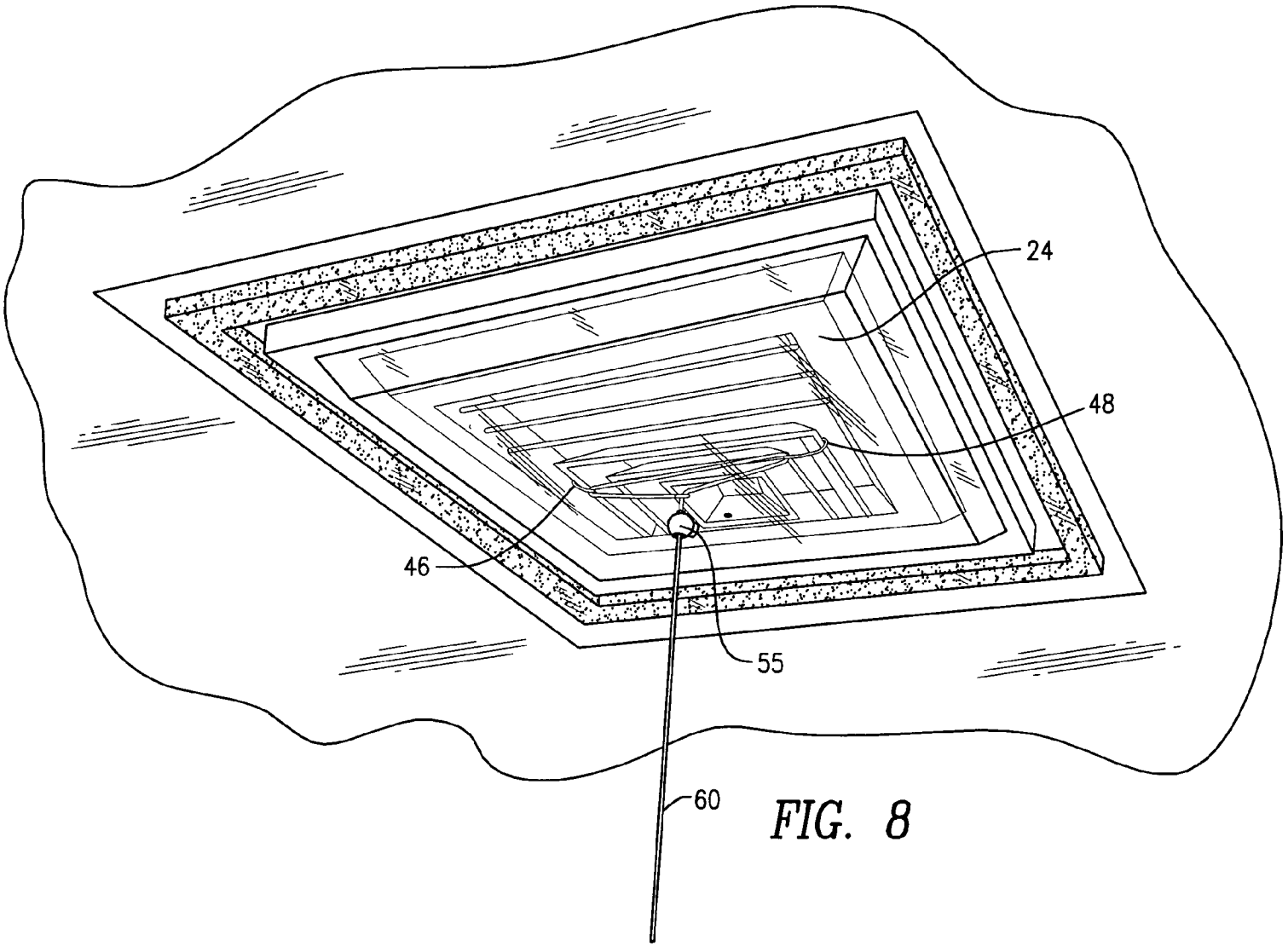
FIG. 8 is a perspective view of the assembly in accordance with one embodiment of the present invention being installed on a ceiling air conditioning vent in accordance with one preferred embodiment of the method of the present invention.
Figure 9:
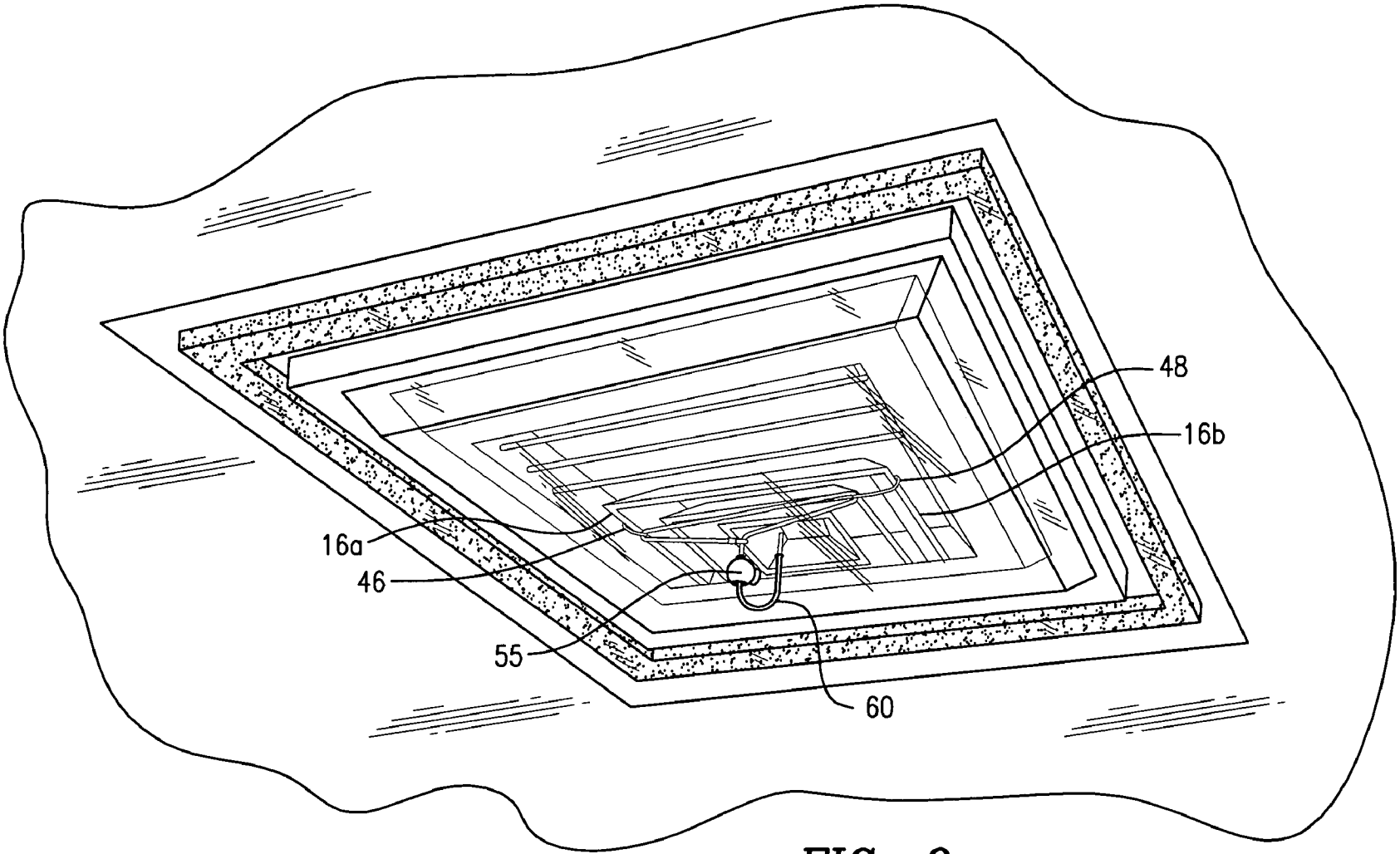
FIG. 9 is a perspective view of the assembly in accordance with one embodiment of the present invention fully installed on a ceiling air conditioning vent in accordance with one preferred embodiment of the method of the present invention.

(when cover is upside down so that top 24 is facing down), the trunk 60 of cord 40 may be centered, as shown in FIG. 8. FIG. 9 shows assembly 10 after the slack 60 below lock 50 is inserted into second aperture 49*b* in cover 20 and away from the user for aesthetic reasons.

Figure 10:
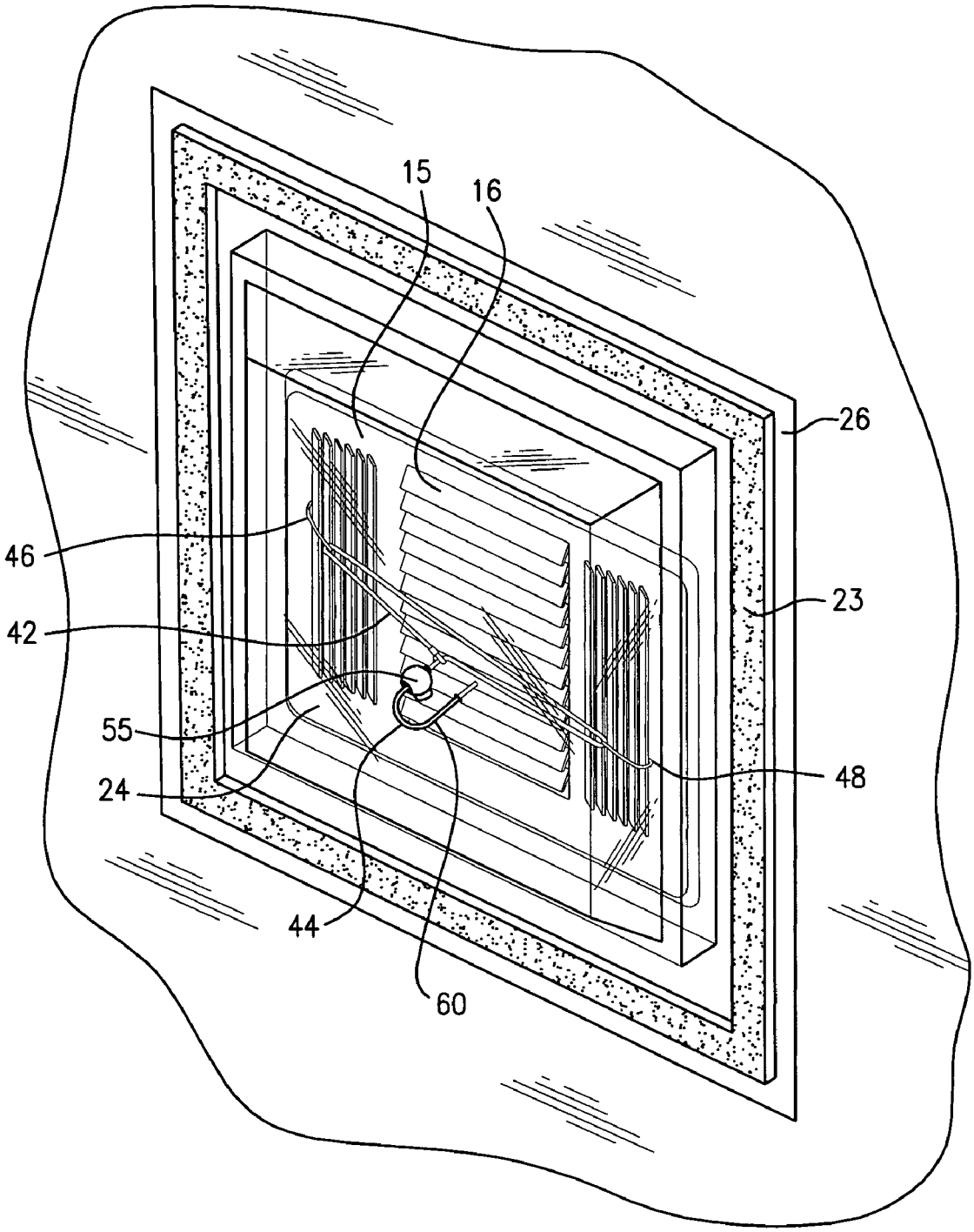
FIG. 10 is a perspective view of the assembly of the present invention installed on a wall air conditioning vent.

FIG. 10 shows assembly 10 installed on a grill 16 of a vent of wall air conditioner.

Although generally cover 20 may be rigid or semi-rigid this not include a compressible sealing element 23. Foam 23 may not be a porous foam that lets air through since foam 23 may be used to create an air-tight seal between cover 20 and vent area 99. Foam 23 or other compressible material may be sufficiently supple to mesh with any ceiling irregularities in vent area 99. As used herein, "vent area" 99 may encompass the area surrounding the vent, such as the ceiling for a ceiling vent and may also encompass a portion of the vent itself, for example an outer perimeter area of the vent surrounding the grill 16, as seen in FIG. 6B. "Adhesive material" as used herein encompasses adhesive and Velcro®.

Figure 11:
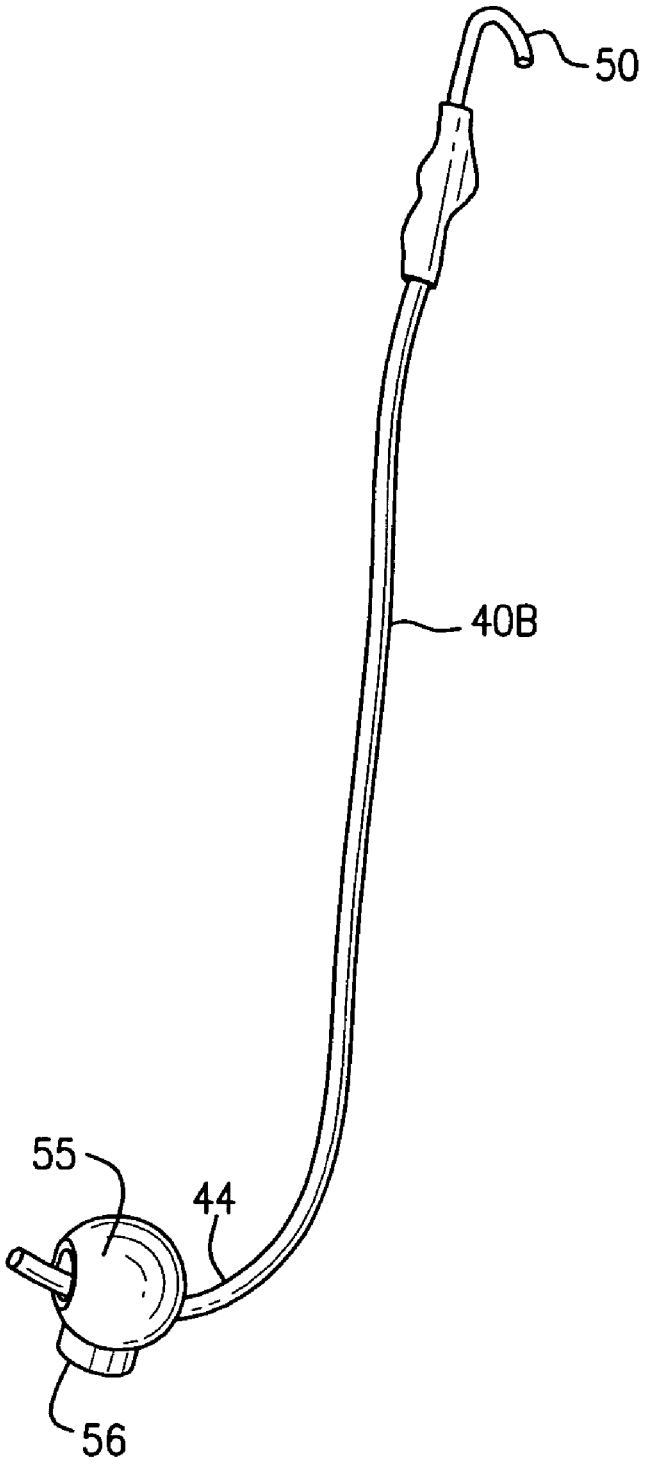
FIG. 11 is a perspective view of a single-hook cord in accordance with one embodiment of the present invention.
Figure 12:
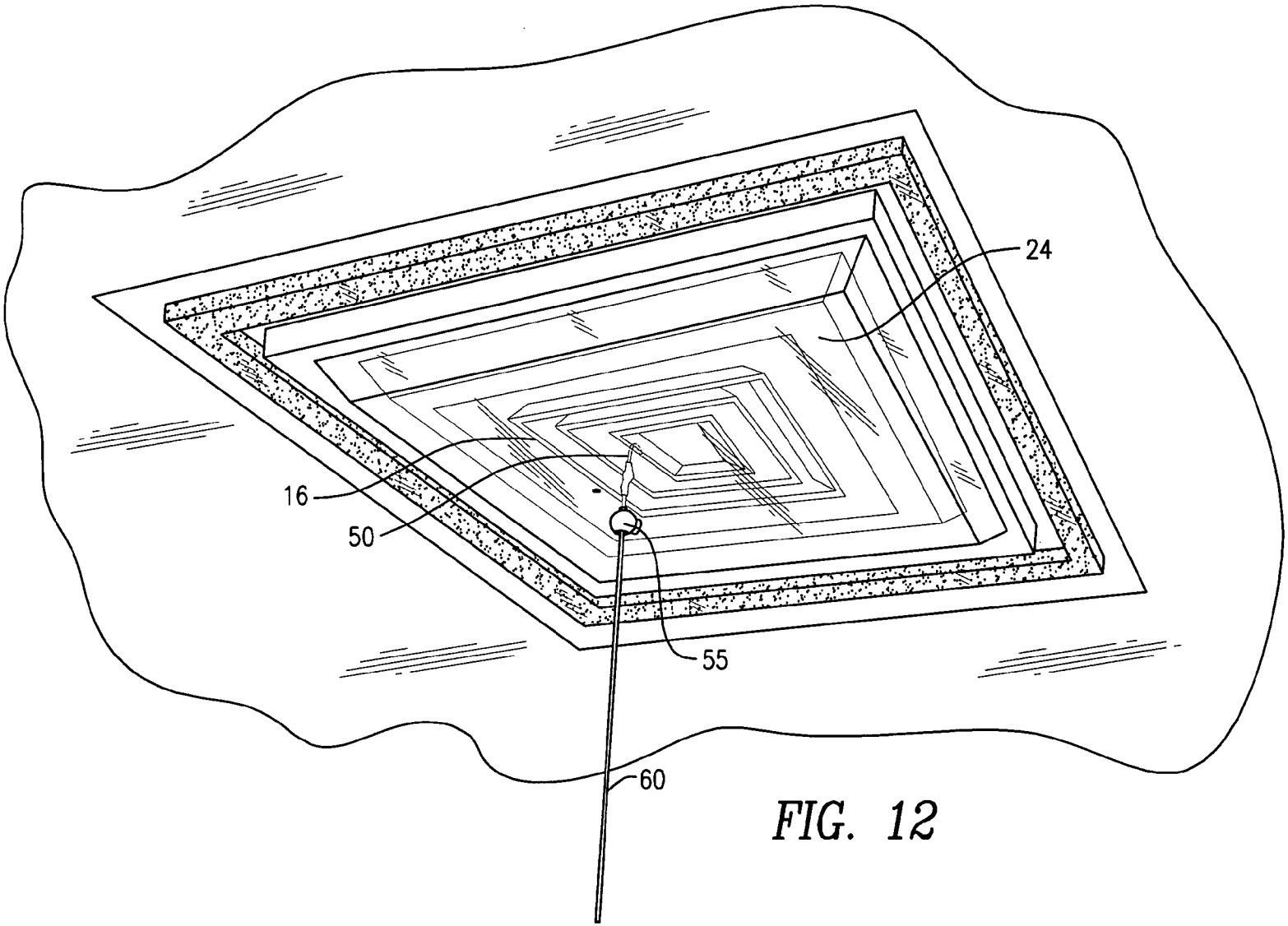
FIG. 12 is a perspective view.

As seen in FIG. 11, certain grills 16 may be shaped so as to allow attachment of a single hook onto grill 16 which hook 50 may be positioned directly above an aperture of cover 20. This may occur, for example, where the fins of the grill 16 may be off-center and an edge of one of the fins of the grill 16 may be centered directly above the aperture in cover 20. In this case, it may be possible to use cord 40B with only a single hook 50 at the attaching end, in conjunction with cover 20, as seen in FIG. 11 and FIG. 12. This may require even less time to install, although the single hook version may not be appropriate for certain shaped grills 16. It is also noted that the cord 40A shown in FIG. 5 may also be used with one single active hook for appropriate grills 16 and this may or not be accompanied by removal of hooks 46, 48 (when free end 44 has no lock 55).

Figure 13:
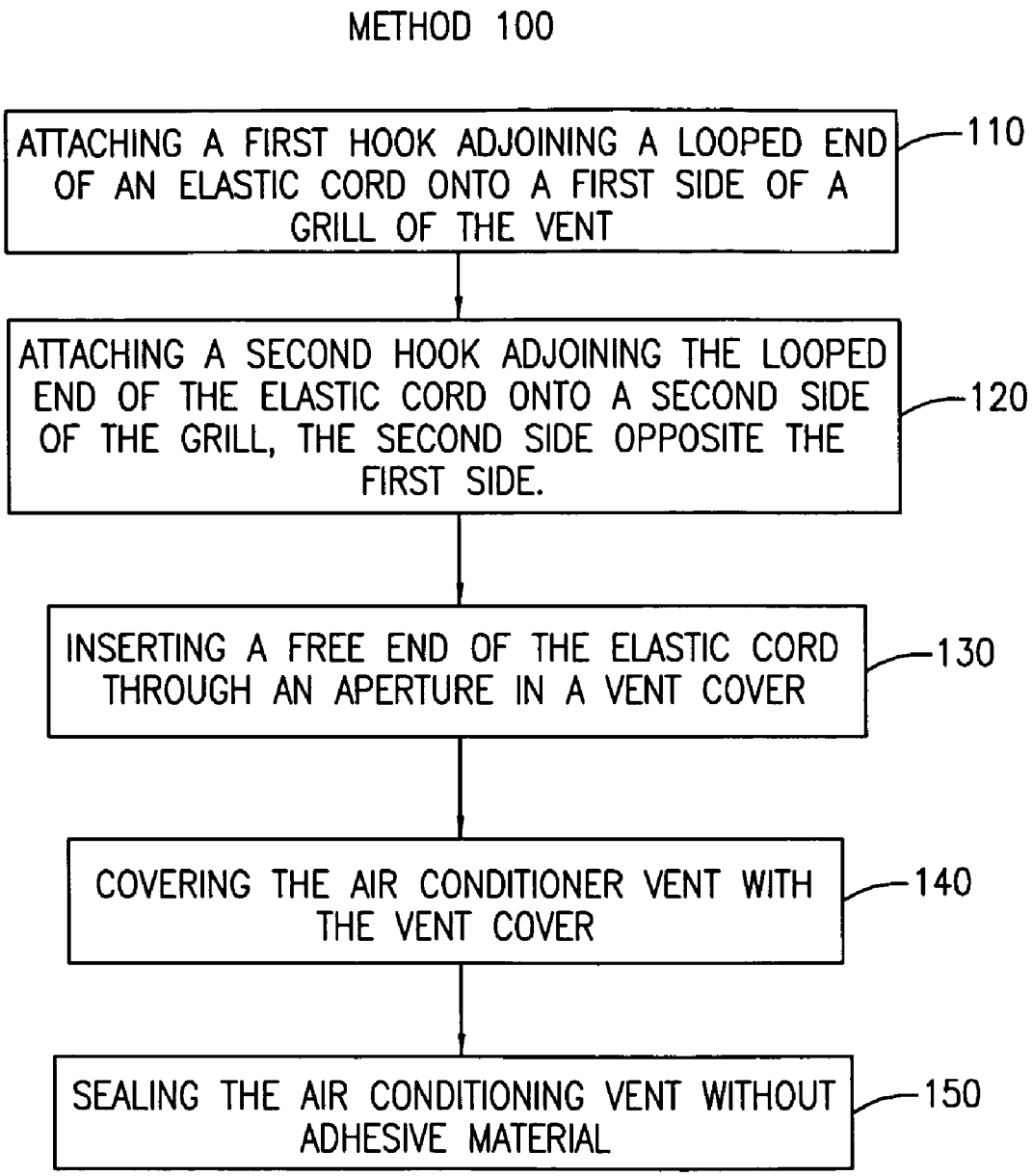
FIG. 13 is a flow chart showing a method in accordance with the present invention.

As seen from FIG. 13, the present invention may also be characterized as a method 100 of sealing an air conditioning vent. The air conditioning vent may be a ceiling central air conditioning vent or a wall air conditioner. Method 100 may include a step 110 of attaching a first hook 46 adjoining a looped end 42 of an elastic cord 40 onto a first side 16*a* of a grill 16 of the vent 11. Method 100 may further include a step 120 of attaching a second hook 48 adjoining the looped end 42 of the elastic cord 40 onto a second side 16*b* of grill 16. Typically, second side 16*b* may be located opposite first side 16*a*.

Method 100 may further include a step 130 of inserting a free end of the elastic cord 40 through an aperture 49*a* in the vent cover 20. Method 100 may also include a step 140 of covering the air conditioning vent with the vent cover. Covering the air conditioning vent with the vent cover may be carried out by sliding a lock along the free end to urge the vent cover against a vent area adjacent the air conditioning vent. Method 100 may also further comprise tightening the first and second hooks to the grill by pulling the free end of the elastic cord. Method 100 may further include a step 150 of sealing the air conditioning vent without adhesive material. The step 150 of sealing the air conditioning vent may comprise pressing the vent cover 20 against the vent area to create an air tight seal using a compressible material around the vent cover. The steps 140 and 150 of covering the air conditioning vent with the vent cover and sealing the vent cover by pulling the free end of the elastic cord may be carried out in one motion. Method 100 may also include sliding a barrel lock up the free end to urge the vent cover against a vent area adjacent the air conditioning vent. After the heating season, when the air conditioning vent is needed for keeping the environment cool, the user may remove the vent cover from the air conditioning vent by releasing the lock 50, slipping lock 50 off free end 44 and allowing the vent cover's weight to let it move from the vent area which can be done without stripping any paint from the vent area 99. Method 100 may be performed whether or not the air conditioning vent 15 is made from metal.

It should be understood, of course, that the foregoing relates to exemplary embodiments of the invention and that modifications may be made without departing from the spirit and scope of the invention as set forth in the following claims.

We claim:

1. An assembly for covering a grille of an air conditioning vent to completely block air flow, comprising:

(a) a rigid or semi-rigid plastic cover, wherein said cover has a compressible foam along its perimeter for creating an air-tight seal between said cover and a vent area including said grille and wherein there are two small holes in the center area of said cover;

(b) an elastic cord having an eyelet forming a looped end and a free end, wherein said looped end has an adjustable size and has two hooks having a first end freely slidable on said looped end and a second end opposite said first end forming a U-shaped hook, wherein said two hooks are configured to attach to said grille but not permanently fixed to said grille and detachable, wherein pulling said free end of said elastic cord tightens said looped end and said hooks, and wherein said free end of said elastic cord fits through one of said two small holes in the center area of said cover and is stowed into the other said small hole in the same said cover;

(c) a barrel lock, which is larger than said small holes, is located on an opposite side of said cover than said looped end and along a trunk of said elastic cord for controlling a slack of said trunk projecting outside said cover creating tension and locking said cover to a vent area.

2. A method of sealing an air conditioning vent, comprising:

(a) attaching one of said hooks of claim 1 adjoining said looped end of said elastic cord of claim 1 onto one side of a grille of said vent;

(b) attaching a second the other said hook of claim 1 adjoining said looped end of said elastic cord of claim 1 onto a second the opposite side of said grille;

(c) inserting said free end of said elastic cord of claim 1 through one said small hole of claim 1 in said cover of claim 1;

(d) tightening said two hooks of claim 1 attached to said grille by pulling said free end of said elastic cord;

(e) sliding said barrel lock of claim 1 up along said free end of said elastic cord to urge said cover against a vent area adjacent the air conditioning vent without adhesive material and locking said cover by said barrel lock;

(f) inserting extra said elastic cord below said barrel lock into the other said small hole of claim 1 in said cover of claim 1 to stow extra said cord and block air flow from such small hole;

(g) removing said cover from an air conditioning vent by releasing said barrel lock of claim 1 and allowing said cover's weight to let it move from a vent area without stripping paint from said vent area.

3. An assembly for covering a grille of an air conditioning vent to completely block air flow, comprising:

(a) a rigid or semi-rigid plastic cover, wherein said cover has a compressible foam along its perimeter for creating an air-tight seal between said cover and a vent area and wherein there is single small hole in the center area of said cover;

(b) an elastic cord having an eyelet forming a looped end and a free end, wherein said looped end has an adjustable size and has two hooks having a first end freely slidable on said looped end and a second end opposite said first end forming a U-shaped hook, wherein said two hooks are configured to attach to said grille but not permanently fixed to said grille and detachable, wherein pulling said free end of said elastic cord tightens said looped end and said hooks, and wherein said free end of said elastic cord fits through said single small hole in the center area of said cover;

(c) a barrel lock, which is larger than said small holes, is located on an opposite side of said cover than said looped end and along a trunk of said elastic cord for controlling a slack of said trunk projecting outside said cover creating tension and locking said cover to a vent area.

4. An assembly for covering a grille of an air conditioning vent to completely block air flow, comprising:

(a) a rigid or semi-rigid plastic cover, wherein said cover has a compressible foam along its perimeter for creating an air-tight seal between said cover and a vent area and wherein there is single small hole in the center area of said cover;

(b) an elastic cord having an eyelet forming a looped end and a free end, wherein said looped end has an adjustable size and has a look having a first end freely slidable on said looped end and a second end opposite said first end forming a U-shaped hook, wherein said hook is configured to attach to said grille but not permanently fixed to said grille and detachable, wherein pulling the other free end of said elastic cord tightens said hook, and wherein said the other free end of said elastic cord fits through said single small hole in the center area of said cover;

(c) a barrel lock, which is larger than said single small hole, is located on an opposite side of said cover than said looped end and along a trunk of said elastic cord for controlling a slack of said trunk projecting outside said cover creating tension and locking said cover to a vent area.

* * * * *